US006274836B1

(12) United States Patent
Walach

(10) Patent No.: US 6,274,836 B1
(45) Date of Patent: Aug. 14, 2001

(54) METHOD AND SYSTEM FOR MULTI-STREAM OBJECT SORTING

(75) Inventor: Eugene Walach, Haifa (IL)

(73) Assignee: International Business Machines Corp., Armonk, NY (US)

( * ) Notice: Subject to any disclaimer, the term of this patent is extended or adjusted under 35 U.S.C. 154(b) by 0 days.

(21) Appl. No.: 09/407,142

(22) Filed: Sep. 28, 1999

(30) Foreign Application Priority Data

Oct. 8, 1998 (EP) ..... 98480068

(51) Int. Cl.[7] ..... B07C 5/00
(52) U.S. Cl. ..... 209/584; 209/583; 209/900
(58) Field of Search ..... 209/584, 583, 209/DIG. 900, 576, 577

(56) References Cited

U.S. PATENT DOCUMENTS

| | | | | |
|---|---|---|---|---|
| 3,889,811 | * | 6/1975 | Yoshimura | 209/566 |
| 5,287,976 | * | 2/1994 | Mayer et al. | 209/547 |
| 5,901,855 | * | 5/1999 | Uno et al. | 209/584 |
| 5,981,891 | * | 11/1999 | Yamashita et al. | 209/584 |
| 6,107,588 | * | 8/2000 | De Leo et al. | 209/584 |

OTHER PUBLICATIONS

European Patent Application (EP 0 916 412 A2; Date of Publication May 19, 1999; Inventor: De Leo Guido).*
De Leo Patent Family Listing (Shirelle Y. Green; Nov. 16, 2001.*

* cited by examiner

*Primary Examiner*—Donald P. Walsh
*Assistant Examiner*—Joseph Rodriguez
(74) *Attorney, Agent, or Firm*—A. Bruce Clay

(57) ABSTRACT

A sorting machine has multiple input bins which are used for all passes of sorting. At each sorting pass, each output bin is associated with and receives input from exactly one input bin. A multi-bin sorter has p input bins and n output bins, n being greater or equal to p. A first sort is performed on the basis of at least part of the sorting key which is associated to each article, providing n output groups of articles corresponding to the n output bins. The sorted articles in n output bins are then grouped in p input bins and resorted by the multi-bin sorter providing n new output groups of articles, each output group being associated with and fed by exactly one of the input bins. The first sorting could be based on a first portion of the sorting key, and the second sorting could be based on a second portion of the sorting key, the first and second portions being non-disjoint.

22 Claims, 3 Drawing Sheets

METHOD AND SYSTEM FOR MULTI-STREAM OBJECT SORTING

FIELD OF THE INVENTION

The present invention relates to apparatus and methods for sorting articles, and in particular to methods for sorting items of mail using a mail sorting machine.

BACKGROUND OF THE INVENTION

Many methods for sorting articles are known. Modern article sorting practice, especially sorting practice for items of mail, is based on the use of sorting machines. Many different sorting machines and methods for their use are known.

Typically, in the case of sorting mail, special purposes machines are used for sorting flats, which generally comprise: envelopes, particularly large envelopes; cards; and other generally flat items of mail. One example of a prior art sorting machine is the Muller-Martini flat sorter, which is well known in the art, many other sorters are also known in the art.

Some examples of apparatus and methods for mail sorting are described in the following U.S. patents:

U.S. Pat. No. 5,009,321 to Keough describes a multiple-pass sorting system for sorting mail pieces in accordance with a delivery order sequence.

U.S. Pat. No. 5,054,602 to Kent et al describes a sorting system comprising a plurality of selectively dischargable sorting conveyors.

U.S. Pat. No. 5,287,271 to Rosenbaum describes a data processing system for optimizing mail piece sorting using real time statistical data.

U.S. Pat. No. 5,311,597 to Rosenbaum describes a method and system for active pigeon hole sorting of mail, including elimination of pigeon holes for those not receiving mail on a particular day.

U.S. Pat. No. 5,421,464 to Gillmann et al describes a method for sequencing parcels, including a sorting plan in which overfilling of individual stacking compartments is avoided.

U.S. Pat. No. 5,547,063 to Bonnet describes a sorting system for high speed sorting of packages, including a feeding mechanism, a conveying system, and ejection modules.

U.S. Pat. No. 5,667,078 to Walach describes an apparatus and method for mail sorting, including generating a first sequence number for each subset of mail, sorting the first subset into batches according to the first sequence number, associating one ofthe first sequence numbers corresponding to the destination addresses of the mail items in the first subset, generating a second sequence number, sorting the second subset into batches according to the second and first sequence numbers while disregarding N of the most significant digits of the first sequence number, interleaving the batches from the first and the second subset, and sorting according to the N most significant digits of the first sequence number. The method is intended to allow porting of the mail to begin prior to all the mail being physically present at the sorter.

U.S. Pat. No. 5,770,841 to Moed et al describes a system and method for reading package information, the system including an imaging system and a label decoding system.

FIG. 1 comprises a simplified block diagram illustration of a typical prior art item sorter, also termed herein an article sorter; typical item sorters include sorters intended for items of mail, which are known by various terms including: a mail sorter, a sorting machine, a mail sorting machine, and a flat sorting machine. In state-of-the art sorters a first plurality of input bins 10 is provided, comprising in the example of FIG. 1, P input bins. Typically, items such as flats are pre-coded, either by the sender or in a pre-processing step, with a bar code signifying the destination of the item, typically but not necessarily represented as an integer code, such as a mail carrier route code. The items are then placed, in arbitrary groups, into each of the P input bins 10.

Items from each of the P input bins 10 are fed to a Programmable Sorting Mechanism 20. Typically, the Programmable Sorting Mechanism 20 is operative to sort input items placed in any of the P input bins 10 in accordance with all or a portion of the bar-coded destination code; the portion of the destination code used for sorting is generally programmable by an operator of the sorter. The Sorting Mechanism 20 typically reads the bar codes and distributes the items received from the P input bins 10 into a second plurality of output bins 30, shown in FIG. 1 as N output bins, according to the programmed portion of the bar code on each item.

Item sorters such as the item sorter of FIG. 1 are operative to arbitrarily combine the input from each of the P input bins 10 during sorting, such that no distinction is made by the Sorting Mechanism 20 based on the particular input bin 10 from which an item is fed to the Sorting Mechanism 20. In other words, items from any or all of the P input bins 10 may be sorted into any or all of the N output bins 30; it will be appreciated by persons skilled in the art that this common property of item sorters limits the type of sorting method which can be successfully used with such an item sorter.

Generally in item sorters, the number of output bins 30, N, is at least equal to, and is usually significantly greater than, the number of input bins 10, P. Even if there are a relatively large number of output bins 30, N, often it is desirable to sort the output into more categories than the number of output bins 30, N, such as, for example, if the number of different carrier routes is greater than the number of output bins 30, N.

The problem of sorting items by distributing the items into categories or piles, where the number of piles is small relative to the number of desired categories or possible sorting keys, is well-known. One reference describing known methods for such sorting is Knuth, *The Art of Computer Programming* Vol. 3, "Searching and Sorting", 1973 edition, pages 170–171, 177, 379–380, and 384. Knuth describes distribution sorting, also known as radix sorting, which is very well known in the art and is known in the art of mail sorting. The terms "distribution sorting" and "radix sorting" will be used interchangeably throughout the present specification and claims. As described by Knuth, radix sorting consists of least significant digit radix sorting, which begins at the least significant digit of a sorting key; and most significant radix sorting, which begins at the most significant digit of a sorting key. In both types of radix sorting, sorting proceeds linearly through the entire sorting key in the direction implied by the choice of beginning digit.

Radix sorting of items having an associated sorting code, such as a destination code or carrier route code, may be performed with any convenient base or radix, the radix being chosen based on characteristics such as, for example, number of input and output bins, of the sorting machine being used or, in the case of sorting inside a computer program, on program and memory requirements.

By way of example only, consider a radix sorting method for using a sorter having one input bin and 10 output bins to sort items having up to 1000 distinct sorting codes ranging from 000 to 999. The items are first input into the input bin and sorted according to least significant digit. The resulting output in the 10 output bins is then stacked in order, from sorted digit 0 to 9, and placed in the input bin again. In a second pass, the items are sorted according to the second-least-significant digit. The resulting output in the 10 output bins is then stacked in order, from most recently sorted digit 0 to 9, and placed in the input bin again. Finally, a third sorting pass is performed based on the third-least-significant, or most significant, digit. The resulting output in the 10 output bins is again stacked in order, from sorted digit 0 to 9.

It will be appreciated, as is well known in the art, that the radix sorting method described above is a reasonably efficient and well-known method which is well suited to item sorters with a single input bin. Unfortunately, although the method can be performed at maximum efficiency with multiple input bins in the first pass, only a single input bin can be used for subsequent passes, since the input from the plurality of input bins 10 is treated in a single integrated pass by the Sorting Mechanism 20, as previously described. For this reason, radix sorting is inefficient when used with an item sorter having a plurality of input bins, since some input bins are unused after the first pass.

It is also known to perform radix sorting from most significant digit to least significant digit, and use of this method is known, particularly in a geographically distributed manner, in mail systems where mail is first sorted by region, or most significant digit, then by postal area, or next most significant digit, and so on. After mail has been distributed to an individual mail sorting center it is known to then sort mail by methods such as those described above.

SUMMARY OF THE INVENTION

The present invention seeks to provide an improved method for sorting articles, particularly including items of mail, using a sorting machine such as a mail sorting machine. The methods of the present invention are particularly suited to use with a sorting machine having multiple input bins, since the methods of the present invention are designed to use multiple input bins for all passes of sorting, not only for the first pass as is known in the prior art and as described above. By way of example only and without limiting the generality of the foregoing, the methods of the present invention are useful for sorting with a Muller-Martiri flat sorter.

In the present invention, sorting keys in each pass of sorting after the first pass are chosen so that each output bin of a sorting machine is associated with and receives input from exactly one input bin, the output of each pass being arranged as the input of the next pass in such a way as to maintain the rule that each output bin is associated with and receives input from exactly one input bin. It is appreciated that, generally, more than one output bin is associated with each input bin.

In a preferred embodiment of the present invention, the sorting machine is programmed to sort according to a sorting key comprising a combination of: high-order digits, which digits are part of the sorting key for each pass; and low-order digits, which change during each pass. Such a method of sorting, ultimately producing the same result as a least-significant-digit radix sort but utilizing multiple input bins in every pass, is termed herein a "mixed most/least significant digit radix sort".

There is thus provided in accordance with a preferred embodiment of the present invention a method for sorting articles, the method including providing a multiplicity of articles to be sorted, each one of the multiplicity of articles having an associated sorting key, providing a multi-bin article sorter having a first plurality p of input bins and a second plurality n of output bins, n being greater than or equal to p, using the multi-bin article sorter to sort the multiplicity of articles based, at least in part, on at least part of the sorting key associated with each one of the multiplicity of articles, to produce n output groups of articles corresponding respectively to the second plurality n of output bins, and performing a further sort including grouping the n output groups of articles into p input groups, and resorting the p input groups using the multi-bin article sorter, each of the p input groups being placed in one of the first plurality p of input bins, to produce n new output groups of articles corresponding respectively to the second plurality n of output bins, wherein each of the n new output groups is associated with and fed by exactly one of the p input bins.

Further in accordance with a preferred embodiment of the present invention the step of performing a further sort includes performing each of the grouping step and the resorting step more than once.

Still further in accordance with a preferred embodiment of the present invention each of the multiplicity of articles includes an article of mail, and the sorting key is based on a destination address associated with the article of mail, and the multi-bin sorter includes a multi-bin mail sorter.

Additionally in accordance with a preferred embodiment of the present invention the multi-bin mail sorter includes a Muller-Martini flat sorter.

Moreover in accordance with a preferred embodiment of the present invention the step of using includes sorting each of the multiplicity of articles based on a first portion of each associated sorting key, and the step of resorting includes sorting each of the p input groups based on a second portion of each associated sorting key, and the first portion and the second portion are non-disjoint.

Further in accordance with a preferred embodiment of the present invention each associated sorting key is representable as a number including at least a high order portion, a low order portion, and a middle portion, and the first portion of each associated sorting key includes the high order portion and the low order portion.

Still further in accordance with a preferred embodiment of the present invention the low order portion is null.

Additionally in accordance with a preferred embodiment of the present invention the second portion includes the high order portion and at least part of the middle portion.

Moreover in accordance with a preferred embodiment of the present invention the step of performing a further sort includes performing a radix sort.

Further in accordance with a preferred embodiment of the present invention the radix sort includes a mixed most/least significant digit radix sort.

Still further in accordance with a preferred embodiment of the present invention the step of grouping includes grouping the n output groups of articles into p input groups according to a grouping rule based on the high order portion.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 2:
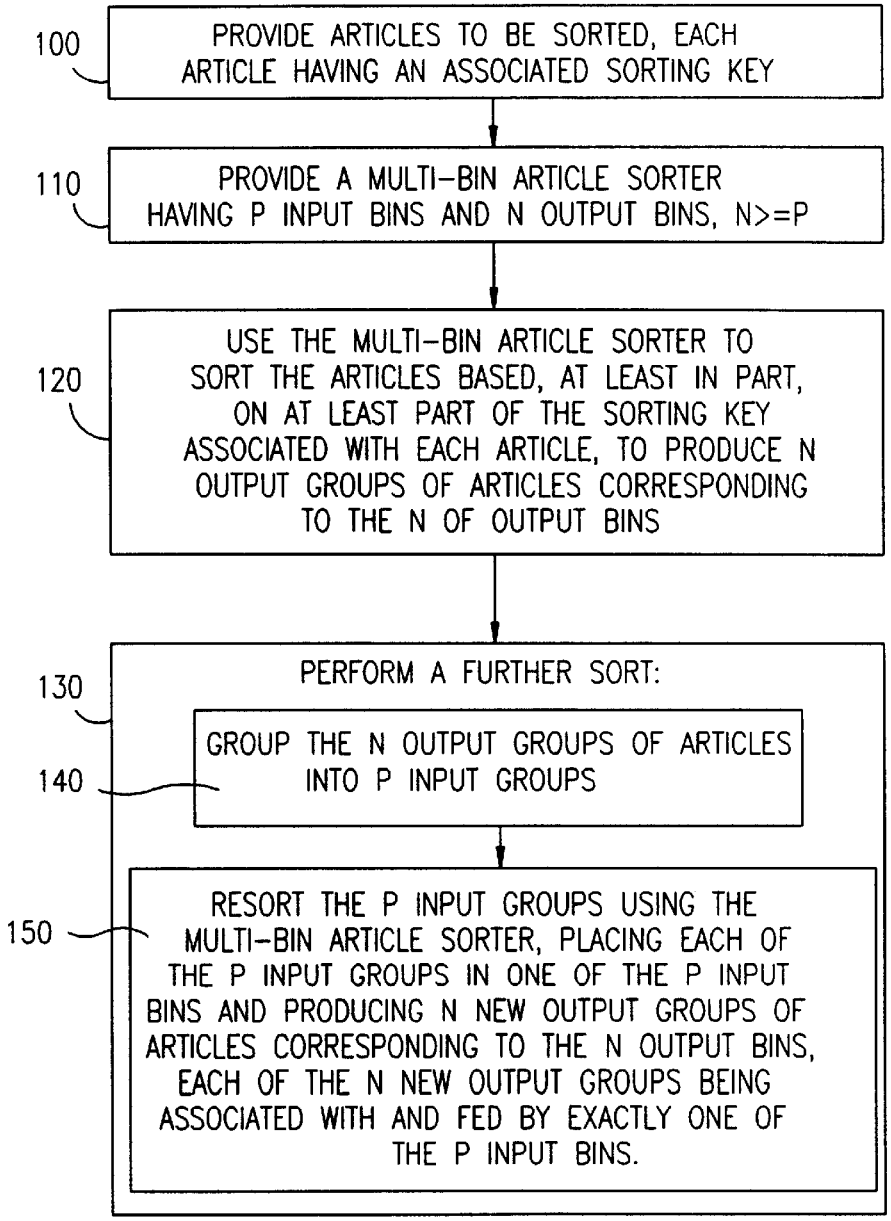
FIG. 2 is a simplified flowchart illustration of a preferred embodiment of a method of sorting articles, the method being operative in accordance with a preferred embodiment of the present invention.

Reference is now made to FIG. 2, which is a simplified flowchart illustration of a preferred embodiment of a method of sorting articles, the method being operative in accordance with a preferred embodiment of the present invention. The method of FIG. 2, which is designed for use with a multi-bin article sorter, allows use of multiple input bins for all passes of sorting, not only for the first pass as is known in the prior art and as described above. The method as shown in FIG. 2 preferably includes the following steps:

Articles to be sorted, typically a multiplicity of articles to be sorted, are provided. Each article has an associated sorting key (step 100). Typically, the sorting key is indicated on the article by means of a bar code or other machine readable code, as is well-known in the art; alternatively, it is appreciated that any other appropriate means of associating the sorting key with the article may be used.

It is appreciated that a wide variety of types of sorting keys may be used. For purposes of simplicity of description, examples of sorting keys comprising decimal numbers will be used throughout the present specification. It is appreciated, however, that numbers in any base, alphabetic codes, mixed codes, or any other appropriate codes may be used, and that a person skilled in the art could modify the method illustrated in FIG. 2 to operate properly with any such appropriate codes, using methods well known in the art.

Figure 1:
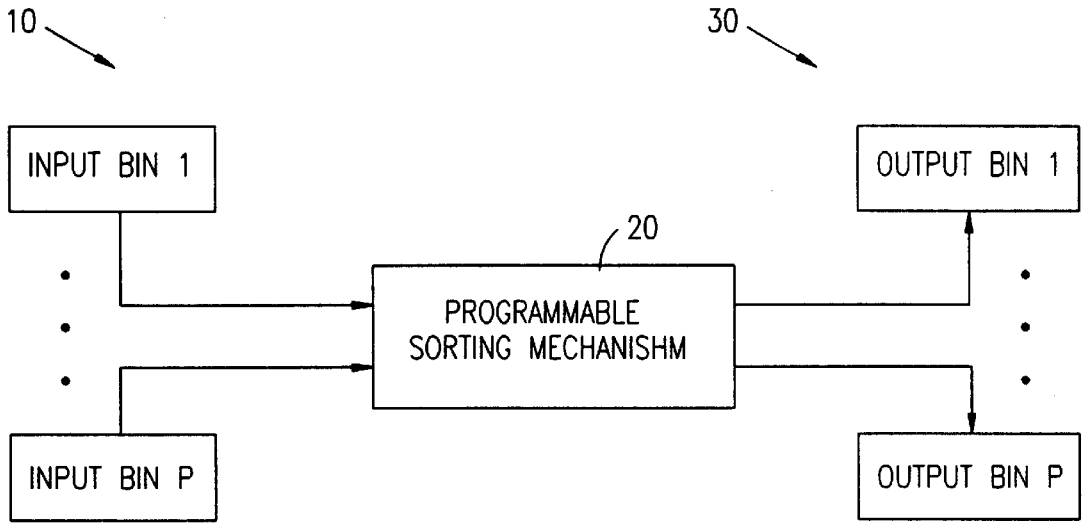
FIG. 1 PRIOR ART
FIG. 1 is a simplified block diagram illustration of a typical prior art item sorter.

A multi-bin article sorter is provided. The multi-bin article sorter may be similar to the prior art sorter shown in FIG. 1, or may comprise any other appropriate multi-bin sorter. An appropriate multi-bin sorter preferably comprises a first plurality of input bins, designated herein as P input bins, and a second plurality of output bins, designated herein as N output bins; generally, N is greater than or equal to P (step 110). Without limiting the generality of the foregoing, one example of an appropriate multi-bin article sorter comprises a Muller-Martini flat sorter.

In a first sorting pass step, the multi-bin article sorter is used to sort the articles. The articles are preferably sorted based, at least in part, on at least part of the sorting key associated with each article, into N output groups of articles, one output group of articles being placed by the sorter in each of the N output bins thereof (step 120).

A further sort is then performed (step 130). In the further sort, each of the following steps is typically performed one or more times:

The N output groups of articles are grouped into P input groups (step 140). The P input groups are resorted by placing each of the P input groups into a corresponding one of the P input bins. The sorter is used to sort the P input groups into N new output groups, each of the N new output groups being associated with and fed by exactly one of the P input bins (step 150).

Figure 3:
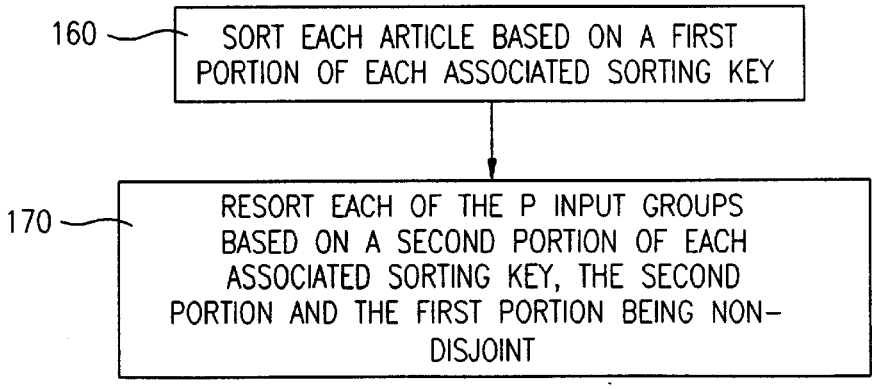
FIG. 3 is a simplified flowchart illustration of a preferred implementation of a portion of the method of FIG. 2.

Reference is now made to FIG. 3, which is a simplified flowchart illustration of a preferred embodiment of a portion of the method shown in FIG. 2. The steps of FIG. 3 describe a preferred embodiment of portions of steps 120 and 150 of FIG. 2. The method of FIG. 3 preferably comprises the following steps:

In step 120, each article is sorted according to a first portion of each associated sorting key (step 160). In step 150, each of the P input groups is resorted based on a second portion of each associated sorting key, the second portion and the first portion being non-disjoint (step 170). The term "non-disjoint", as used throughout the present specification and claims when referring to two portions of a sorting key to indicate that the two portions include a common portion, such as a common digit or a common bit.

For example and without limiting the generality of the foregoing, if a sort key comprised a 3-digit decimal number, the first portion comprised the high order digit and the low order digit, and the second portion comprised the high order digit and the middle digit, the first portion and the second portion would be non-disjoint because they include a common digit, comprising the high order digit.

In contrast to the present invention, it is appreciated that in least significant digit radix sorting and in most significant digit radix sorting, which are well-known in the art, portions of a sorting key used in different sorting passes are disjoint.

Figure 4:
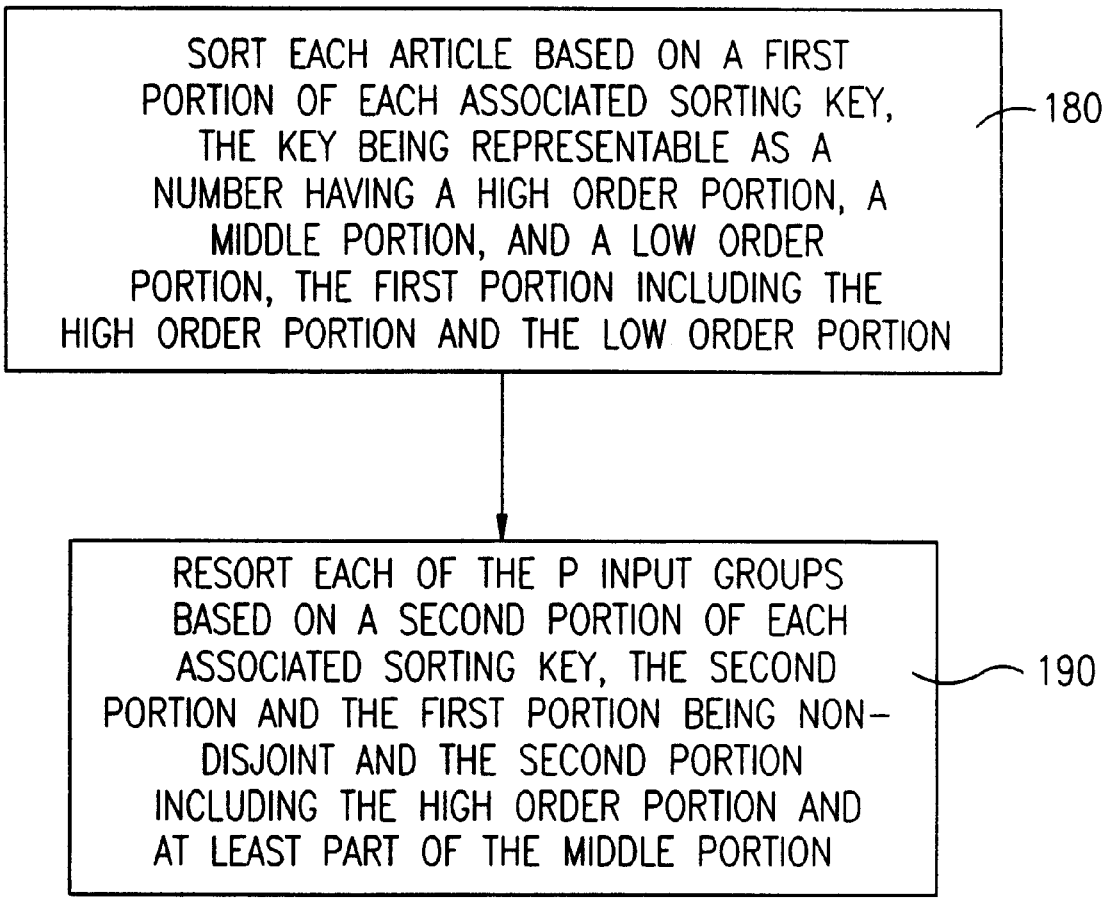
FIG. 4 is a simplified flowchart illustration of a preferred implementation of the method of FIG. 3.

Reference is now made to FIG. 4, which is a simplified block diagram illustration of a preferred implementation of the method shown in FIG. 3. The method shown in FIG. 4 preferably comprises the following steps:

Each article is sorted, in a first pass, based on a first portion of the sorting key associated with each article. The sorting key is taken to be representable, possibly with an appropriate mathematical transformation as is well-known in the art, as a number, the number comprising a high order portion, a middle portion, and a low order portion. The first portion of the sorting key includes the high order portion and the low order portion (step 180). It is appreciated that the low order portion may, in some cases, be null, (i.e., contains no numbers/characters) such that the first portion of the sorting key includes only the high order portion. The term "low order portion" as used throughout the present specification and claims, is meant also to encompass a case where the low order portion is null.

Each of the P input groups, described above with reference to FIG. 2, is sorted in a second or subsequent pass, based on a second portion of the sorting key associated with each article. The second portion and the first portion are non-disjoint, as described above with reference to FIG. 3, and the second portion includes the high order portion and at least part of the middle portion (step 190).

By way of example only and without limiting the generality of the foregoing, assume that the sorting key comprises a 4-digit decimal number. The sorting key might be understood as comprising: a 1-decimal-digit high order portion comprising the high order digit; a 2-decimal-digit middle portion comprising the middle two digits; and a 1-decimal-digit low order portion comprising the low order digit. The first portion might then comprise the high order portion and the low order portion. In a first iteration of step 130 of FIG. 2 the second portion might comprise the high order portion and the low-order digit of the middle portion. In a subsequent iteration of step 130 of FIG. 2, the second portion might comprise the high order portion and the high-order digit of the middle portion.

Generally, in the method of FIG. 4 and continuing with the preceding example, the part of the middle portion used in consecutive iterations of step 130 of FIG. 2 generally moves from the low order end of the middle portion to the high order end of the middle portion, covering each digit of the middle portion without skipping any digits.

The following more concrete example is offered by way of further example only, and is not meant to be limiting:

Let P=2 and N=20; that is, let a multi-bin article sorter be provided including 2 input bins and 20 output bins. Let a multiplicity of articles be provided, each article being coded with a sorting key, the sorting keys each comprising 3 digits and ranging between 000 and 999.

First pass: let the multiplicity of articles be divided approximately equally between the two input bins. Let the sorter be programmed to sort according to a part of the high order digit, comprising the high order portion, and the low order digit, comprising the low order portion. The sorter is programmed to assign articles to the 20 output bins, numbered 10–29, as follows:

| BIN | HIGH DIGIT | LOW DIGIT |
|---|---|---|
| 10 | 0—4 | 0 |
| 11 | 0–4 | 1 |
| 12 | 0–4 | 2 |
| 13 | 0–4 | 3 |
| 14 | 0–4 | 4 |
| 15 | 0–4 | 5 |
| 16 | 0–4 | 6 |
| 17 | 0–4 | 7 |
| 18 | 0–4 | 8 |
| 19 | 0–4 | 9 |
| 20 | 5–9 | 0 |
| 21 | 5–9 | 1 |
| 22 | 5–9 | 2 |
| 23 | 5–9 | 3 |
| 24 | 5–9 | 4 |
| 25 | 5–9 | 5 |
| 26 | 5–9 | 6 |
| 27 | 5–9 | 7 |
| 28 | 5–9 | 8 |
| 29 | 5–9 | 9 |

The articles sorted into bins 10–19 are then stacked together, in order, and placed in the first input bin. Similarly, the articles sorted into bins 20–29 are then stacked together, in order, and placed in the second input bin. The sorter is programmed to assign articles to the 20 output bins, numbered 10–29, as follows:

| BIN | HIGH DIGIT | MIDDLE DIGIT |
|---|---|---|
| 10 | 0–4 | 0 |
| 11 | 0–4 | 1 |
| 12 | 0–4 | 2 |
| 13 | 0–4 | 3 |
| 14 | 0–4 | 4 |
| 15 | 0–4 | 5 |
| 16 | 0–4 | 6 |
| 17 | 0–4 | 7 |
| 18 | 0–4 | 8 |
| 19 | 0–4 | 9 |
| 20 | 5–9 | 0 |
| 21 | 5–9 | 1 |
| 22 | 5–9 | 2 |
| 23 | 5–9 | 3 |
| 24 | 5–9 | 4 |
| 25 | 5–9 | 5 |
| 26 | 5–9 | 6 |
| 27 | 5–9 | 7 |
| 28 | 5–9 | 8 |
| 29 | 5–9 | 9 |

Finally, the articles sorted into bins 10–19 are stacked together, in order, and placed in the first input bin. Similarly, the articles sorted into bins 20–29 are then stacked together, in order, and placed in the second input bin. The sorter is programmed to assign articles to 10 output bins, numbered 10–19, as follows:

| BIN | HIGH DIGIT |
|---|---|
| 10 | 0 |
| 11 | 1 |
| 12 | 2 |
| 13 | 3 |
| 14 | 4 |
| 15 | 5 |
| 16 | 6 |
| 17 | 7 |
| 18 | 8 |
| 19 | 9 |

The articles in output bins 10–19 are then stacked together, and are now in order.

It is appreciated that additional variations on the method of the present invention are possible such as, for example, adding in marker cards to allow easy partition and distribution of items to second locations after sorting.

It will be appreciated by persons skilled in the art that the method of the present invention, which fully utilizes a plurality of input bins, may be significantly faster than prior art methods. The following computation is intended to provide an approximate comparison of sorting time between a typical prior art method and the method of the present invention.

| Let: | |
|---|---|
| K | represent the number of articles to be sorted; |
| p | represent the number of input bins; |
| [x] | represent the largest integer smaller than or equal to x; |
| t | represent the amount oftime needed for sorting a single article, while passing through a sorting machine with all p input bins operational; and |
| m | represent the number of output bins. |

Given the above definitions, a prior art conventional sorting method requires [logmK]+1 passes. The first pass operates with all input bins, and so requires a total of K×t seconds. The remaining passes, namely [logmK] passes, each use only a single input bin and therefore require p×t seconds for each item, or a total of (([logmK])×K×p×t) seconds. Therefore, the overall sorting time for conventional sorting is given by:

$$(([\log_m K])\times K\times p\times t)+(K\times t)$$

Using the methods of the present invention, the total number of sorting passes is given by:

$$[\log_m/p(K/p)]+1$$

It is appreciated that there may therefore be more passes when using the present invention than in conventional methods. However, each pass of the present invention uses all of the input bins, and therefore requires (K×t) seconds. The overall sorting time is given by:

$$([\log_m/p\ (K/p)]+1)\times K\times t$$

In order to have an estimate of the degree of improvement obtainable, consider a case where 300,000 items are to be sorted daily. Consider providing a sorting machine having p=3 input bins, m=200 output bins, and a peak sorting speed of 36,000 items per hour, t=0.1 seconds. Assume also that 9 hours are available for sorting. Using the results obtained above for the conventional method, conventional sorting will require:

([log200 300000])×300000×3×0.1+300000×0.1=210000 seconds, or approximately 58.33 hours. Given 9 hours available for sorting, 7 machines would be needed.

By contrast, using the methods of the present invention sorting will require:

([log200/3 (300000/3)]+1 )×300000×0.1=90000 seconds, or 25 hours. Thus, would be sufficient using the methods of the present invention, to use 3 sorting machines. Thus, 4 sorting machines would be saved. The potential economic savings are very large, considering that a typical sorting machine might cost several million U.S. dollars, plus the associated building costs of providing space for each machine.

It is appreciated that various features of the invention which are, for clarity, described in the context of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited by what has been particularly shown and described hereinabove. Rather the scope of the invention is defined only by the claims which follow.

What is claimed is:

1. A method for sorting articles, the method comprising the steps of:

providing a multiplicity of articles to be sorted, each one of said multiplicity of articles having an associated sorting key;

providing a multi-bin article sorter having a first plurality p of input bins and a second plurality n of output bins, n being greater than or equal to p;

using the multi-bin article sorter to sort the multiplicity of articles based, at least in part, on at least part of the sorting key associated with each one of said multiplicity of articles, to produce n output groups of articles corresponding respectively to the second plurality n of output bins; and performing a further sort comprising:

grouping the n output groups of articles into p input groups; and resorting the p input groups using the multi-bin article sorter, each of the p input groups being placed in one of the first plurality p of input bins, to produce n new output groups of articles corresponding respectively to the second plurality n of output bins, wherein each of the n new output groups is associated with and fed by exactly one of the p input bins.

2. The method according to claim 1, wherein said step of performing a further sort comprises performing each of the grouping step and the resorting step more than once.

3. The method according to claim 1, wherein each of the multiplicity of articles comprises an article of mail, the sorting key is based on a destination address associated with the article of mail, and the multi-bin sorter comprises a multi-bin mail sorter.

4. The method according to claim 3, wherein the multi-bin mail sorter comprises a Muller-Martini flat sorter.

5. The method according to claim 1, wherein said step of using comprises sorting each of the multiplicity of articles based on a first portion of each associated sorting key, and said step of resorting comprises sorting each of the p input groups based on a second portion of each associated sorting key, and said first portion and said second portion are non-disjoint.

6. The method according to claim 5, wherein each said associated sorting key is representable as a number comprising at least a high order portion, a low order portion, and a middle portion, and said first portion of each associated sorting key comprises said order portion and said low order portion.

7. The method according to claim 6, wherein said low order portion is null.

8. The method according to claim 6, wherein said second portion comprises said high order portion and at least part of said middle portion.

9. The method according to claim 8, wherein said step of performing a further sort comprises performing a radix sort.

10. The method according to claim 9, wherein said radix sort comprises a mixed most/least significant digit radix sort.

11. The method according to claim 6, wherein said step of grouping includes grouping said n output groups of articles into p input groups according to a grouping rule based on said high order portion.

12. A system for sorting articles, comprising:

means for providing a multiplicity of articles to be sorted, each one of said multiplicity of articles having an associated sorting key;

means for providing a multi-bin article sorter having a first plurality p of input bins and a second plurality n of output bins, n being greater than or equal to p;

means for using the multi-bin article sorter to sort the multiplicity of articles based, at least in part, on at least part of the sorting key associated with each one of said multiplicity of articles, to produce n output groups of articles corresponding respectively to the second plurality n of output bins; and means for performing a further sort comprising:

means for grouping the n output groups of articles into p input groups; and means for resorting the p input groups using the multi-bin article sorter, each of the p input groups being placed in one of the first plurality p of input bins, to produce n new output groups of articles corresponding respectively to the second plurality n of output bins, wherein is each of the n new output groups is associated with and fed by exactly one of the p input bins.

13. The system according to claim 12, wherein said means for performing a further sort comprises means for utilizing each of said means for grouping and said means for resorting more than once.

14. The system according to claim 12, wherein each of the multiplicity of articles comprises an article of mail, the sorting key is based on a destination address associated with the article of mail, and the multi-bin sorter comprises a multi-bin mail sorter.

15. The system according to claim 14, wherein the multi-bin mail sorter comprises a Muller-Martini flat sorter.

16. The system according to claim 12, wherein said means for using comprises means for sorting each of the multiplicity of articles based on a first portion of each associated sorting key, and said means for resorting comprises means for sorting each of the p input groups based on a second portion of each associated sorting key, and said first portion and said second portion are non-disjoint.

17. The system according to claim 16, wherein each said associated sorting key is representable as a number comprising at least a high order portion, a low order portion, and a middle portion, and said first portion of each associated sorting key comprises said high order portion and said low order portion.

18. The system according to claim 17, wherein said low order portion is null.

19. The system according to claim 17, wherein said second portion comprises said high order portion and at least part of said middle portion.

20. The system according to claim 19, wherein said means for performing a further sort comprises means for performing a radix sort.

21. The system according to claim 20, wherein said means for performing a radix sort comprises a mixed most/least significant digit radix sort.

22. The system according to claim 17, wherein said means for grouping includes means for grouping said n output groups of articles into p input groups according to a grouping rule based on said high order portion.

* * * * *